United States Patent [19]

Wiggins

[11] Patent Number: 5,033,119

[45] Date of Patent: Jul. 23, 1991

[54] GLOVE FOR ENHANCING ATHLETIC PERFORMANCE

[76] Inventor: Christopher N. Wiggins, 3083 Mariners Dr., #1302, Stockton, Calif. 95209

[21] Appl. No.: 466,499

[22] Filed: Jan. 17, 1990

[51] Int. Cl.[5] ..... A41D 19/00

[52] U.S. Cl. ..... 2/161 A; 2/162

[58] Field of Search ..... 2/16, 17, 18, 161 R, 2/161 A, 162, 19, 20, 167, 168, 170

[56] References Cited

U.S. PATENT DOCUMENTS

| | | | |
|---|---|---|---|
| 965,720 | 8/1964 | Hawtin | 2/167 |
| 2,447,951 | 8/1948 | Lindfelt | 2/167 |
| 3,026,531 | 3/1962 | Holaday | 2/167 |
| 3,952,333 | 4/1976 | Fujita | 2/161 A |
| 4,525,877 | 7/1985 | Chong | 2/161 A |
| 4,843,651 | 7/1989 | Gramza et al. | 2/121 |
| 4,905,321 | 3/1990 | Walunga | 2/160 |

*Primary Examiner*—Werner H. Schroeder
*Assistant Examiner*—Amy Brooke Vanatta
*Attorney, Agent, or Firm*—Majestic, Parsons, Siebert & Hsue

[57] ABSTRACT

The wrist support glove of this invention is designed to enhance athletic performance. The glove comprises a gripping front portion covering the fingers and palm of the user, the gripping surface extending from the front of the fingers to the palm, and a back portion extending from the back of the fingers to the back of the hand. The glove also comprises a wrist portion comprised of one or more elongated flaps, each having a first and second end. The flaps are attached to the glove in such a manner as to provide a figure eight-type support to the hand and wrist. The compression and stabilization of the wrist and hand thus provided enhances athletic performance.

9 Claims, 3 Drawing Sheets

GLOVE FOR ENHANCING ATHLETIC PERFORMANCE

BACKGROUND OF THE INVENTION

The present invention relates to gloves, and, more particularly, to an athletic glove for enhancing athletic performance by providing compression and stabilization of the wrist and hand of the user.

Athletic gloves are worn for a wide variety of sports, including weight lifting, water skiing, windsurfing and racket sports. Such gloves assure a firm grip by providing a perspiration-free surface for gripping objects, thereby improving the user's performance. In sports such as sailing, the fingers of the glove have open ends to permit greater tactile sensitivity and mobility. Gloves also protect the hand from minor injuries, such as scrapes, bruises and blisters.

Wrist supports are worn to protect the wrist joint from serious injury and dislocation that may result from the extreme forces to which the wrist is subjected. In weight lifting, for example, lifters use elastic wraps which are sanctioned by the regulating authority. Wrist supports are used in tennis to keep the wrist locked during certain strokes. In baseball, a wrist support minimizes injury to a batter from sudden rotation of the wrist when the bat hits the ball.

Athletic gloves having wrist supports have been developed to provide some of the above advantages. However, the wrist supports of the prior art gloves typically have one elongated piece of material extending around the wrist portion of the glove which must be tightly wrapped around the user's wrist to be effective. These straps have several major disadvantages. They are difficult to secure tightly with one hand, and when secured, they provide only rotational support for the wrist and not flexional support for the wrist and hand together.

SUMMARY OF THE INVENTION

This invention is based on the observation that a person's performance in many sports can be enhanced if compression and stabilization are provided for a person's wrist and hand. The joint between the wrist and the hand of a person is weak. For this reason it may be difficult for a participant in many sports to direct his or her strength to the hand through the joint. A wrist support glove which provides flexional support for the joint will greatly enhance the person's performance and reduce the risk of injuries. In conventional wrist support devices, such as those described above, support is typically provided only around the user's wrist and not to the joint between the hand and the wrist. The glove of this invention provides flexional support for the joint to enhance performance and reduce the risk of injuries.

The wrist support glove of this invention is for supporting the hand and wrist of a user where the hand has a palm and fingers. The glove comprises a gripping front portion covering the fingers and palm of the user comprised of one continuous piece of material, the gripping surface extending from the front of the fingers to the palm, and a back portion which extends from the back of the fingers to the back of the hand. The glove also comprises a wrist portion comprised of one or more elongated flaps each having a first and second end. The first end of each flap is attached to the front or back portion at locations so that when the fingers of the user wearing the glove are pointing upwards, the first ends of the flaps are substantially at the same horizontal level as the palm and the flaps are at acute angles to the wrist of the user so that the flaps are positioned for wrapping the wrist and the lower part of the palm. The glove also includes means for fastening the wrist portion onto the wrist and palm of the user.

DETAILED DESCRIPTION OF THE INVENTION

Figure 1:
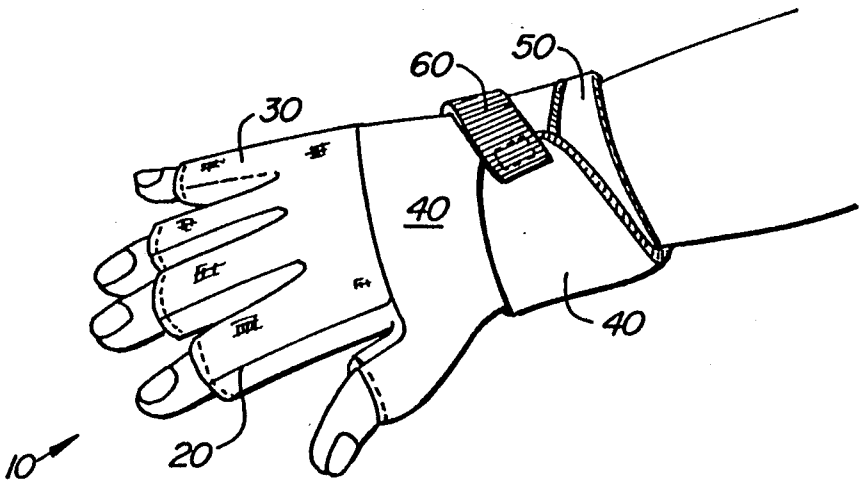
FIG. 1 is a perspective view of a glove to illustrate the preferred embodiment of the present invention, where the glove is shown wrapped around the wrist of the user.

Referring now to FIG. 1, the glove 10 includes a gripping front portion 20, a rear portion 30 and a wrist portion consisting of two flaps 40 and 50.

Figure 2:
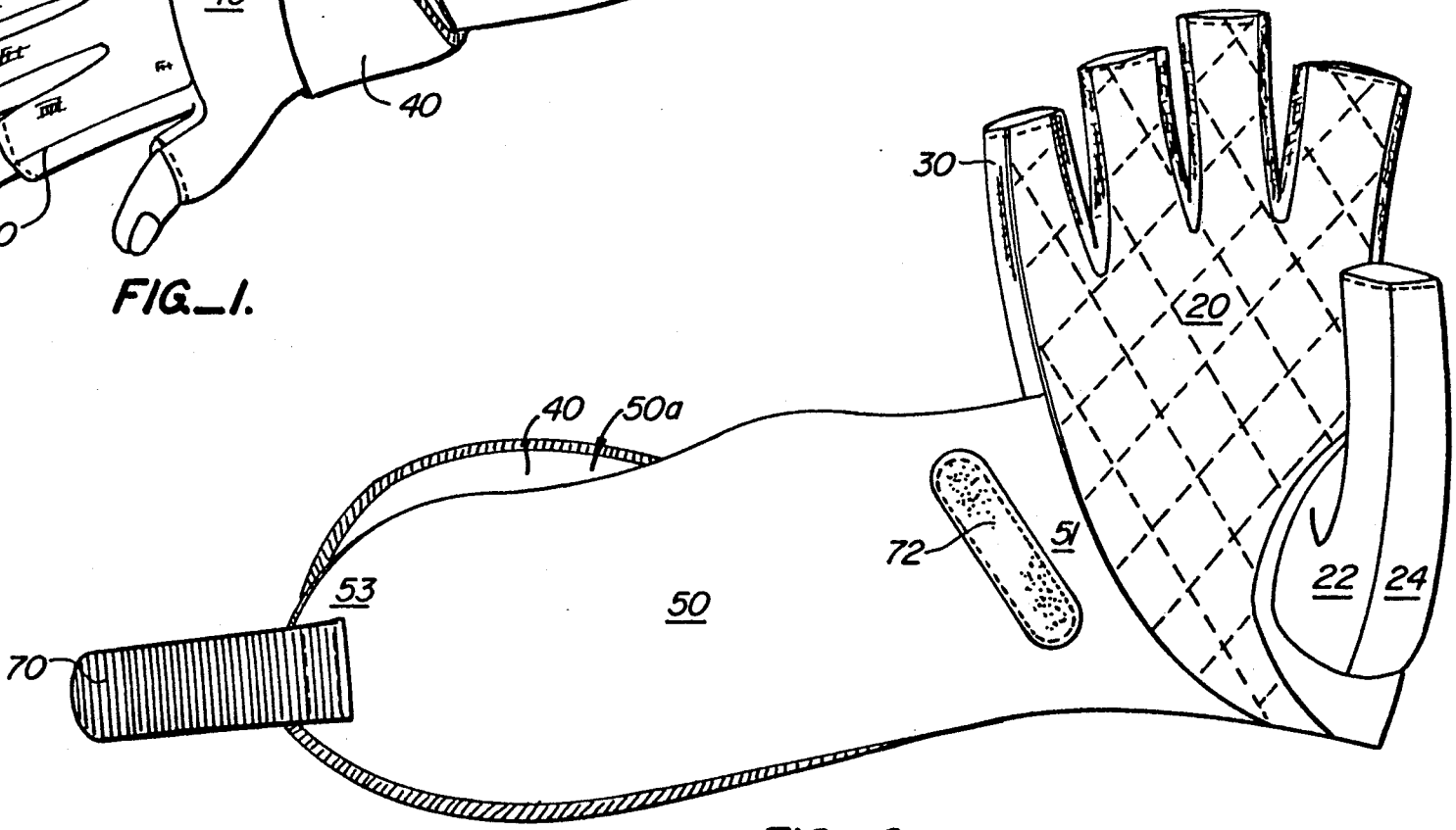
FIG. 2 is a front perspective view of the glove of FIG. 1 shown fully extended.
Figure 3:
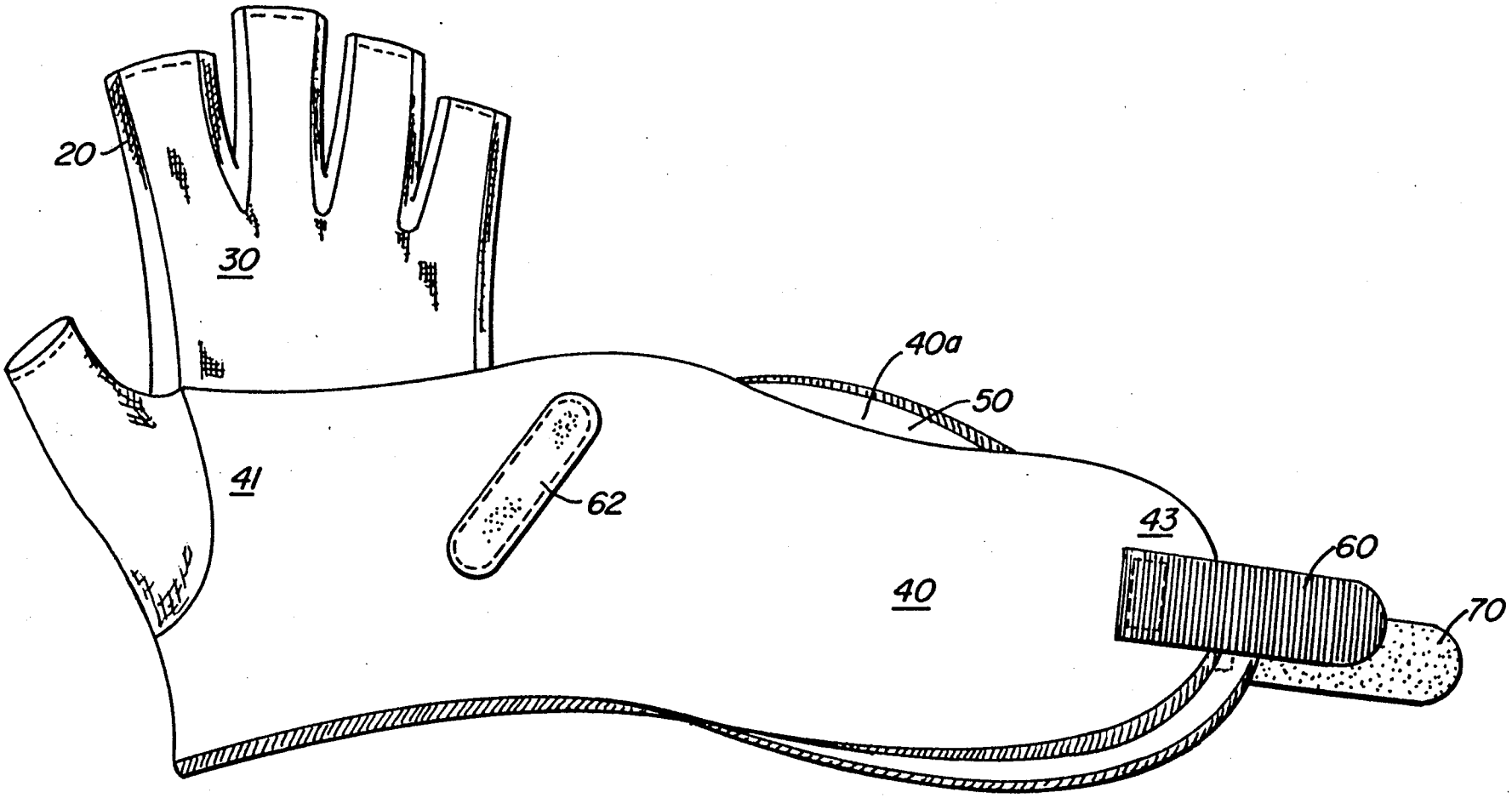
FIG. 3 is a rear perspective view of the glove of FIG. 1 shown fully extended.

The front surface 20 of the glove 10 as shown in FIG. 2 is preferably made of a strong inelastic material such as leather or artificial leather. Leather is used to give the wearer an improved nonslip grip to enhance performance in any sport. Artificial leather, such as Amara, is preferred for water sports because of its durability, flexibility, and fast drying qualities. The leather covers the portion of the glove extending from the front of all four fingers and the entire front surface of the hand ending at the base of the palm. The leather also covers the gripping surface 22 of the inside of the thumb. The rear portion 30 as shown in FIG. 3 is made of a flexible highly elastic material such as ⅛-inch Neoprene. The same material is used for the back of the thumb 24. This rear portion 30 extends from the back of the fingers halfway down the back of the hand. The elastic material provides flexibility for free movement of the fingers without danger of ripping the leather from excess bending of the fingers.

The wrist portion of the glove includes one or more elongated flaps as shown in FIGS. 2 and 3. While in the preferred embodiment the wrist portion has two flaps, it will be understood that only one or more than two flaps may be used and are within the scope of the invention. Flap 50 has a first end 51 and a second end 53. Flap 40 has a first end 41 and a second end 43. In order for the two flaps to support the joint between the hand and the wrist of the user, the flaps should wrap around the lower portion of the palm, the area of the joint and the upper portion of the wrist. For this purpose the two flaps are attached to the front and back portions of the glove in such manner and position that they are suitable for wrapping the above-mentioned portions of the hand and wrist. The two flaps are connected to the front or back portions in such manner that when the fingers of the user's hand wearing the glove are pointing upwards, the first ends 41, 51 are at the same level as the palm of the person's hand. Also when the user's hand is in such position wearing the glove, the two elongated flaps slant downward slightly so that the second ends 43, 53 are lower than the first ends 41, 51, the two flaps making an acute angle with the wrist of the user, where such angle is slightly less than 90°. When the flaps are in such position, they are suitable for wrapping the lower portion of the palm, the joint between the hand and the wrist, and the wrist itself. Preferably, the two flaps are suitable for wrapping in opposite directions, as shown in FIG. 1, to provide a figure eight-type support for the hand and wrist. The detail connections of the flaps to the front and back portions are explained below. The first end 51 is attached to the side of the front portion 20 from the base of the little finger to the base of the palm. Flap 40 is attached to the base of the rear portion 30 in the middle of the back of the hand. In this embodiment the seam is located just beneath the wearer's knuckles. Flap 40 extends around the thumb piece 22, 24 which are sewn into a cutout in the flap 40. Both flaps 40, 50 are contoured (notches 40*a*, 50*a*) so that when they are wrapped around the glove they do not bunch up on the user's palm or beneath the thumb.

FIG. 1 shows the glove in the wrapped position around the wearer's wrist. To use the glove properly, flap 40 is held up and out of the way between the wearer's fingers. Flap 50 is then wrapped around the wearer's hand underneath the thumb so that tab 70 can be attached to fastener 72. Flap 40 is then wrapped around the wearer's palm and thumb so that tab 60 can be attached to fastener 62. In this manner the wrist support flaps offer a very strong yet flexible support which provides compression and stabilization of the wrist and hand joints against both over-rotation and over-flexion. The two-point diagonal support of the invention is structurally superior to the one-point lateral support provided by prior art gloves and wraps. This glove and wrap combination provides two anchor points for support, a new feature which is both more stable and easier to secure with one hand.

Figure 4:
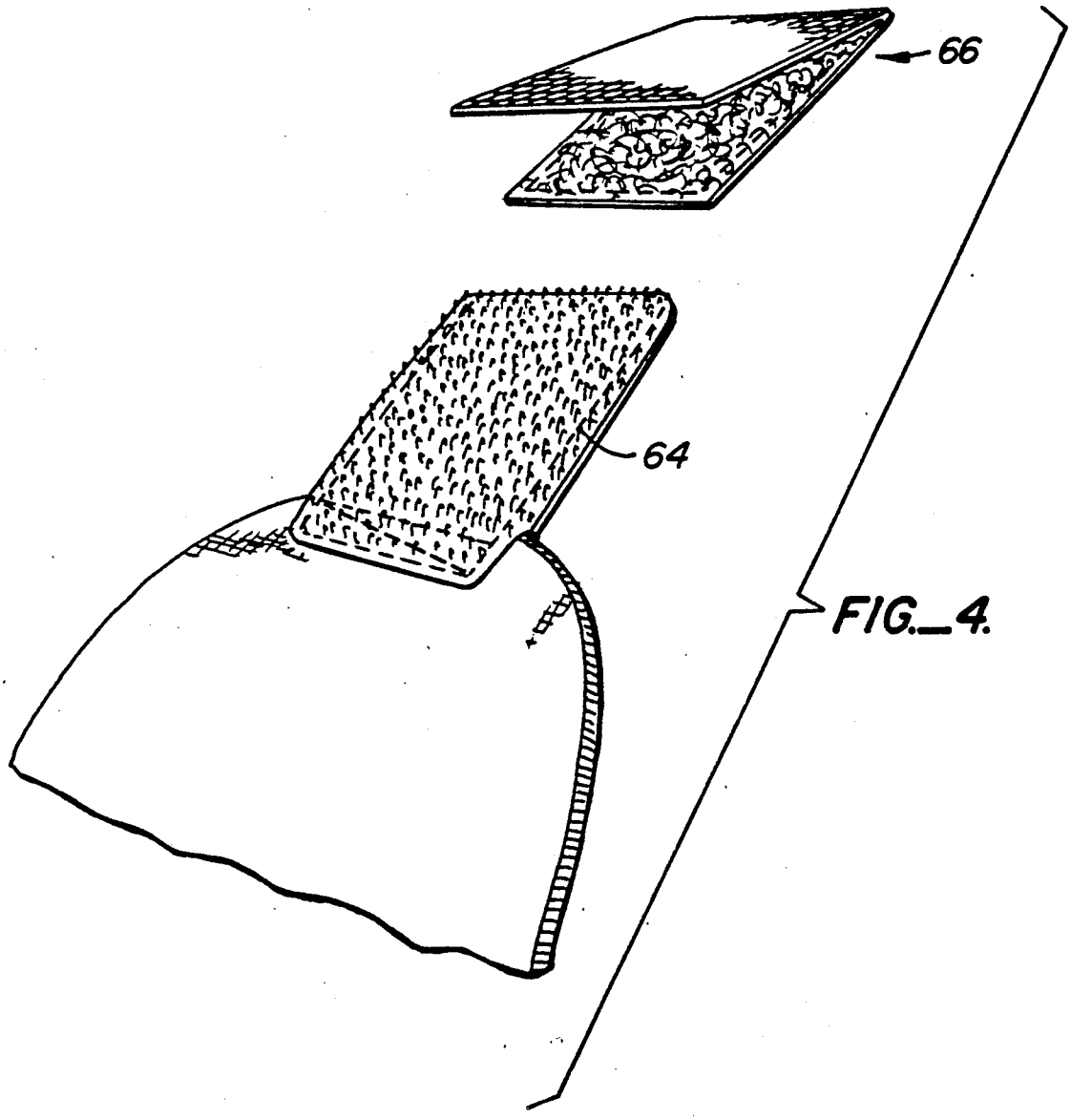
FIG. 4 is a view of one type of fastener used in the glove of FIG. 1.

The flaps can be secured with any type of fastener such as pins, hooks and eyes, or snaps. However, the most secure fastening is provided by use of tabs 60, 70 of Velcro-type hook fastener which engages patches of loops 62 and 72 to achieve a firm fastening. The contours of the flaps and the location of the fasteners are designed to avoid bunching of the material at the base and fingers of the palm. For use in water sports such as waterskiing or windsurfing where the force of flowing water might flip off tabs 60, the tab is replaced by a tab 64 having hooks on both sides, which fits into an envelope 66 with loops on the inside surfaces. This configuration is shown in FIG. 4.

The sports glove of the present invention offers a number of features not provided by prior art gloves. First of all, the use of two overlapping wrist flaps made of Neoprene offers superior rotational and torsional support. The use of Neoprene around the thumb makes it easier to put the glove on the hand. The acute angle of the flaps with respect to the front and back portions of the glove facilitate wrapping the flap around the wrist. The contour of the flaps and the location of the fasteners on the flaps avoid bunching of the material on the thumb and the palm. In addition, the fingers are shaped to be in a curved configuration when the glove is manufactured. This is the same as the natural configuration of the glove after use so that the material comprising both the back and front portions of the glove is not stretched, thus adding life to the glove.

While the present invention has been particularly described with reference to FIGS. 1–4, it should be understood that the specific embodiments are for illustration only and should not be taken as limitations upon the invention. For example, the glove may have contemplated that many changes and modifications may be made by one of ordinary skill in the art without limiting the scope of the invention as disclosed above.

What is claimed is:

1. A wrist support glove for supporting the hand and wrist of a user, the hand having a palm and fingers, said glove comprising:

a gripping front portion covering the fingers and palm of the user comprised of one continuous piece of material, the gripping surface extending from the front of the fingers to the palm;

a back portion which extends from the back of the fingers to the back of the hand;

a wrist portion comprised of two elongated flaps each having a first and a second end, the first end of each of said two elongated flaps being attached to the front or back portion at locations so that when the fingers of the user wearing the glove are pointing upwards, the first ends of the flaps are substantially at the same horizontal level as the palm and said two flaps have portions which are at acute angles to the wrist of the user so that said two flaps are in a position suitable for wrapping the wrist and the lower part of the palm in opposite directions to strengthen support for the wrist; and means for fastening said wrist portion about the wrist and palm of the user.

2. The wrist support glove of claim 1 in which said two flaps are each substantially rectangular in shape.

3. The wrist support glove of claim 1 wherein said wrist portion is formed of Neoprene of ⅛-inch thickness.

4. The wrist support glove of claim 1 wherein each of said two flaps has a width between 2 and 4 inches, and has a length sufficient to provide at least one circumferential wrap around the wrist.

5. The wrist support glove of claim 1 wherein the gripping front portion is formed of leather or synthetic leather.

6. The wrist support glove of claim 1 wherein the back portion is formed of stretchable nylon material of 1/16- inch thickness.

7. The wrist support glove of claim 1 wherein said fastening means comprises a first fastener element secured to said first end of a first of said two flaps and a mating fastener element secured to said second end of said two flaps.

8. The wrist support glove of claim 1 wherein said fastening means comprises a patch of woven loops attached to said first end of a first of said two flaps and a patch of hook fastener attached to said second end of said first of said two flaps.

9. The glove of claim 1, wherein said fastening means fastens said two flaps such that each flap wraps around the wrist in the shape of a loop, said loop being at an acute angle to the wrist.

* * * * *